United States Patent [19]

Marass

[11] 4,136,865

[45] Jan. 30, 1979

[54] SHEET FEEDING APPARATUS

[75] Inventor: Josef Marass, Seehausen, Fed. Rep. of Germany

[73] Assignee: Georg Spiess GmbH, Gersthofen, Fed. Rep. of Germany

[21] Appl. No.: 825,949

[22] Filed: Aug. 19, 1977

[30] Foreign Application Priority Data

Aug. 27, 1976 [DE] Fed. Rep. of Germany ..... 2638783

[51] Int. Cl.[2] ..... B65H 5/34

[52] U.S. Cl. ..... 271/270; 271/182; 271/183; 271/204

[58] Field of Search ..... 271/270, 182, 183, 277, 271/204, 205, 206

[56] References Cited

U.S. PATENT DOCUMENTS

| | | | |
|---|---|---|---|
| 2,625,394 | 1/1953 | Brown | 271/183 |
| 3,232,605 | 2/1966 | Plummer | 271/183 |
| 3,779,545 | 12/1973 | Schuhmann | 271/183 |

FOREIGN PATENT DOCUMENTS

| | | | |
|---|---|---|---|
| 1158844 | 7/1969 | United Kingdom | 271/182 |

*Primary Examiner*—Richard A. Schacher
*Attorney, Agent, or Firm*—Max Fogiel

[57] ABSTRACT

A sheet feeding apparatus with a cross-cutter in front and an arrangement, following the cross-cutter, for forming a series of underlapping sheets with lifting and holding elements in a region between two withdrawal devices driven at different feed speeds. These elements lift the rear end of each sheet to form a lead-in gap for the following sheet. The lift and holding elements are fastened, furthermore, to continually driven transport elements and are kept on a straight path in the engagement area slightly delayed relative to the following withdrawal device. The lift and holding elements are uniformly distributed across the width of the sheet, and are fastened to a strip picked up by chains located on the side. Several strips are provided spaced at sheet-to-sheet spacing. The track of the lift and holding elements descends slightly in the transport direction. The strips connected to the lateral chains are guided in lateral rails which are adjustable.

20 Claims, 6 Drawing Figures

SHEET FEEDING APPARATUS

BACKGROUND OF THE INVENTION

The present invention relates to a sheet feeding apparatus with a cross-cutter in front and, following the cross-cutter, a device for forming a series of overlapping sheets with lifting and holding elements located in the region between two withdrawal devices driven at different feed speed; these elements lift the rear edge of each sheet to form a lead-in gap for the following sheet.

An arrangement of this type is known from German Patent 20 10 467. With the known arrangement, to form the lift and holding elements, reciprocating suction groups are used which are arranged so that the one group is placed in the starting position while the other group is preferably dragged by the sheet itself into the sheet run direction. These suction groups may be suspended like a pendulum on a common axis. An arrangement of this type is relatively simple and with low operating speeds has led to useful results. However, for increased speeds, this arrangement was found too slow. Because of the high sheet there is the danger that the sheet grabbed by one suction group slips off the suction (cups) or is pulled off so that the lead-in gap for the following sheet becomes lost.

This could be counteracted by an outside drive of the unit formed by the suction groups. However, such a drive would be extremely difficult and unduly expensive since the reciprocating suction groups must be moved at constant speed throughout their entire operating range and must be greatly retarded and accelerated in the region of each reversal point. A drive meeting these requirements requires considerable expenditure. In addition, the mass (inertial) forces act unfavorably. The aforementioned German Patent No. 20 10 467 also mentions suction rollers. To guarantee a sufficiently long holding travel (path), large roller diameters would have to be used which would lead to excessive space requirement. Also, the large size would result in increased material and manufacturing costs.

An attempt has been made to increase the limited operating speed by placing a periodically actuated striking flap for lifting the sheets. This would avoid suction devices and the related construction cost and time, but would not remove the disadvantages of discontinuous operation.

It is, therefore, the object of the present invention to avoid the disadvantages of the known arrangements and to provide with small expense an arrangement of the above type which even with increased speeds guarantees a high functioning reliability and a careful operation and still saves space.

Another object of the present invention is to provide an arrangement of the foregoing character which may be readily maintained in service and may be economically fabricated.

A further object of the present invention is to provide an arrangement, as described, which has a substantially long operating life.

SUMMARY OF THE INVENTION

The objects of the present invention are achieved by providing that the lift and holding elements are fastened to rotating continually driven transport elements and are kept on a straight path in the engagement area slightly delayed relative to the following withdrawal device. These measures permit much higher operating speeds than can be expected from known arrangements. The constant speed of revolution of the lift and holding elements permits a simple drive construction with relatively few and light elements so that not only the part and space requirement, but also the power requirement is relatively small. Accordingly this affects not only the manufacturing costs, but also the operating and maintenance costs in a beneficial manner. Also, the measures in accordance with the invention are suited for a particularly flat construction, still permitting a great length of sheet at the lift and holding elements. Also, the slight delay of the lift and holding elements relative to the following withdrawal device leads to a certain straightening of the doubly clamped sheet and thus not only ensures maintenance of a clean lead-in gap for the following sheet, but also facilitates a subsequent sheet alignment. Besides these advantages, the continuous construction in accordance with the present invention leads to a much lower noise level than a discontinuous construction.

In accordance with an advantageous embodiment of the invention, several lift and holding elements may be uniformly distributed across the sheet width; these elements are fastened to a strip picked up by chains located on the side. These measures evidently result in a particularly stable and rugged construction which is very impact-resistant. A large number of staggered strips may be provided. This leads to a maximum expansion of the engagement area of the lift and holding elements, retaining a continuous mode of operation.

Another embodiment of the present invention may be a slight dip of the track of the lift and holding elements in the transport direction. Such a direction of the rear sheet end combines well with the desired wedge shape of the lead-in gap, with the drop height of the rear sheet end at the end of the engagement travel being particularly small.

To relieve the transport elements formed by chains located on the side and to maintain an exact track for the lift and holding elements, the strips may be guided by guide rails located on the side. The path provided by the guide rails may, however, deviate from the chain track in such a way that the strips driven by the chains can be delayed relative to them and relative to the following withdrawal device. A high variability can be achieved by means of adjustable guide rails.

It is also possible to achieve the delay in accordance with the present invention without guiding the rails by driving the transport elements holding the lift and holding elements, for example, the chains moving the mentioned strips, at a slightly lower speed than the following withdrawal device. Preferably the speed differential can be set so that the lift and holding elements precisely at the end of the engagement travel disengage from the rear end of the sheet. To ensure a suitable relative motion between it and the held sheet end, the holding force of the lift and holding elements is adjusted with the required precision.

Another possibility for compensating the mentioned relative motion may be that the strip holding the lift and holding element is elastically (by spring) connected to the associate transport elements. Here the spring force corresponds to the force expended for stretching the sheet held by the lift and holding elements. With this design, the held sheet rear edge is released by controlling the lift and holding elements. This results in an exact instant of release.

With a particularly advantageous embodiment, mechanical grippers with controlled gripper fingers contacting a gripper device may be provided to form the lift and holding elements. The opened gripper fingers travel underneath the sheet rear edge and lift it automatically during the closing process, without requiring further auxiliary means. Lift elements located underneath the sheet edge, such as striking flaps, can be omitted to advantage. Also, this permits a stable and rugged design ensuring reliable operation. The gripper fingers are controlled by a control contour located at the side which may be fixed or, to make possible exact setting and resetting, it may be adjustable. The speed deviation in accordance with the present invention between the lift and holding elements and the associated drive elements and the following withdrawal device, which provides a certain sheet straightening, leads to a certain relative displacement of the sheet rear edge relative to the lift and holding elements or the associate drive elements. To avoid visible pressure marks on the sheet rear edge pulled out from the mechanical grippers preferably used, smooth surfaces may be provided for the holding surface of the gripper fingers and the counter-surface of the gripper device. It may be particularly advantageous if at least one of these surfaces is formed by a roller, preferably a slow moving one.

According to a second inventive embodiment based on the use of compressed air, the solution of the above problem is possible as follows: the lift the holding elements, have air nozzles directed into a gap formed by the sheet to be lifted and a guide surface above the sheet path. The high air speed further increased by the narrow cross-section of the gap leads to an underpressure (vacuum) through which the sheet rear edge can be attracted and stopped. By a blow direction opposite to the sheet travel direction, the desired sheet straightening can be further intensified so that the following sheet can feed easily into the lead-in gap prepared for it. At the same time, the air pillow between the sucked-in sheet and the guide piece prevents a direct sheet contact and thus assures a particularly careful handling of the sheets. This solution does not require parts guided along a longer engagement path and still avoids the disadvantages of the known arrangement. Also, a particularly light and space saving construction is possible here.

U.S. Pat. No. 3,198,046 proposes a compressed-air arrangement to produce a sequence of underlapping sheets. With this known arrangement, a blowing device is located underneath the sheet track; this blower blows at the end of the passing sheet from below and is to lift it to form a lead-in gap for the following sheet. The known arrangement, in contrast with the present invention, does not operate with underpressure above the sheet to be lifted, but with excess pressure acting from below on the sheet to be lifted. There is the danger that the lifted sheet is pressed against a support and is damaged there. Also, with the known arrangement there only is a narrow gap between successive sheets for the action of the upward air current, which may have a negative effect on the reliability of operation.

To ensure sufficient suction force and uniform sheet feed, several adjacent blow nozzles may be provided across the sheet path. These blow nozzles may be located on at least one flap having a guide surface covered with blow nozzles; this flap can be lowered onto the sheet track with the guide surface covered with nozzles at the rhythm (pacing) of the cross-cutter. This makes possible a particularly wide lead-in gap and still ensures reliable sheet acceptance.

The mentioned flap may be fastened to a pivoted axis which can be actuated by means of a cam disk driven by the cross-cutter. The axis accommodating the flap may serve as an air lead-in pipe to which the nozzles are connected via the bores provided in the flap.

The air exiting at the end of the gap, formed by the sheet to be lifted and the guide surface, can be taken away by suitable screening means in order to protect the assemblies ahead, particularly the cross-cutter and the following withdrawal device, from being struck by the compressed air.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
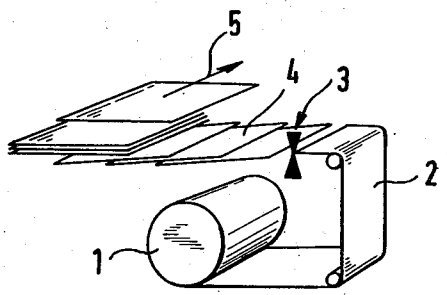
FIG. 1 shows the mode of operation of a roller sheet unit.

The processing of roll material in sheet machines is connected with many advantages, such as considerable increase in output and cost savings. As shown in FIG. 1, a paper track 2 is pulled off a roll 1 and cut into sheets by a cross-cutter indicated at 3. Then the cut sheets, by means of a device to be explained in detail later, are brought together to a sequence of underlapping sheets shown at 4, which, as shown at 5, runs into a sheet feeding apparatus (not shown in detail) which delivers the sheets at regular intervals to a sheet-processing machine, say, a printing press.

Figure 2:
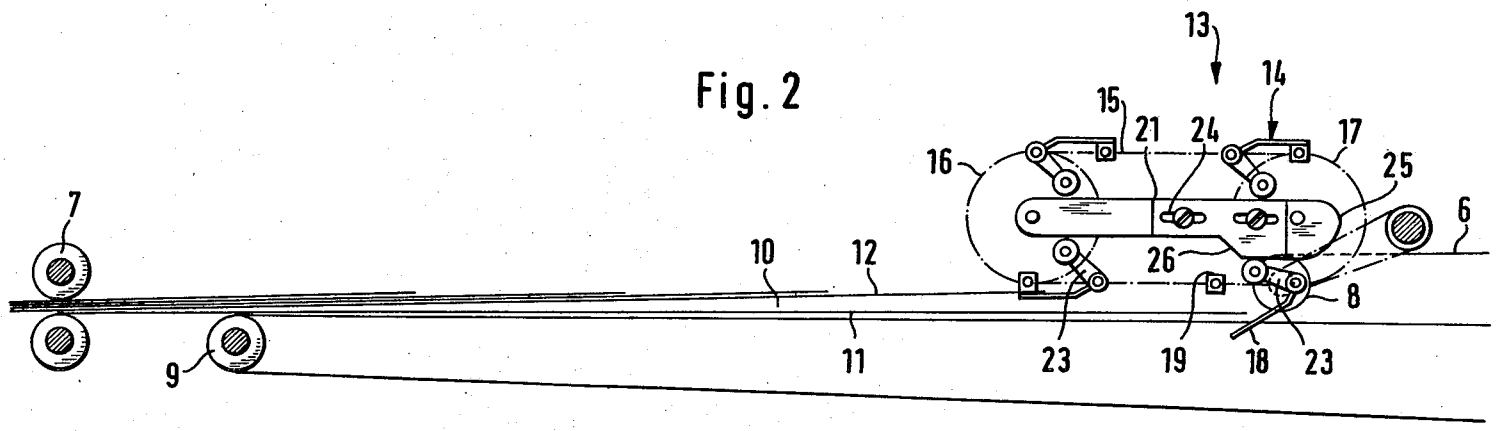
FIG. 2 shows a schematic of a first embodiment of the device in accordance with the present invention to form a series of underlapping sheets as seen from the side.

To form the sheet sequence indicated at 4, as shown in FIG. 2, there are provided two withdrawal devices 6 and 7 following the cross-cutter 3; of these, the withdrawal device 6 immediately following the cross-cutter 3 is driven with increased speed relative to the paper track and the following withdrawal device 7 is driven at reduced speed, so that the cut sheets are first accelerated and then accumulate. In the embodiment shown, to form the withdrawal apparatus 6 immediately following cross-cutter 3, a pair of belts with an upper and lower transport belt is used; it is passed over associated deflector rolls 8 or 9. To form the following slow withdrawal device 7, a pair of rollers is to be used in the embodiment shown. To form a lead-in gap 10 for the sheet 11 withdrawn by the withdrawal device 6 from the cross-cutter 3 at high speed underneath the preceding sheet 12 and thus to ensure a safe underlapping, there is located between the withdrawal devices 6 and 7 operating at different speeds a device 13; this device is equipped with lift and holding elements 14 which grab and lift the rear edge of each passing sheet and release it after a certain period. During this engagement, the lift and holding elements 14 are guided in accordance with the invention on a straight track slightly descending in the transport direction and driven at a slightly reduced speed relative to the operating speed of the following withdrawal device 7. The grasped sheet end can thus be guided along a sufficiently long stretch, straightening the entire sheet and forming a clean long lead-in gap for the next-following sheet. To accommodate the lift and holding elements 14, transport chains 15 located preferably on the side and driven uniformly in one direction may be provided; they are located at a distance from each other corresponding to the engagement region of the lift and holding elements 14. This uniform operation without necessary accelerations and decelerations permits high operating speeds. As indicated in FIG. 2, several successively engaged lift and holding elements 14 are provided.

Figure 4:
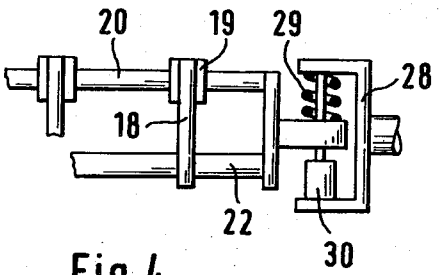
FIG. 4 shows another detail of the arrangement of FIG. 2.

The lift and holding elements 14 may be formed by suction arrangements taken along by transport chains 15. In the embodiment of FIG. 2, to form the lift and holding elements 14, mechanical clamping grippers equipped with gripper fingers 18 and associated gripper bases 19 are used. To ensure a sufficient sheet support across the track width, several uniformly spaced grippers are provided. As shown in FIG. 4, to accommodate such a gripper series, continuous gripper strips may be provided which are driven by the transport chains 15 located on the side. The mutual distance of successive gripper strips 20, connected to the transport chains 15, corresponds exactly to the sheet-to-sheet distance. To relieve the transport chains 15, the gripper strips 20 driven by them may be guided in their own guide rails. To bring about a certain gripper delay relative to the withdrawal device 7, their path deviates from the chain track. By means of adjustable guide rails, great variability can be achieved in this respect. In the embodiment shown, the mentioned delay, as already indicated, is to be achieved by a reduced drive speed of the transport chains 15. Guide rails are not used.

To control the gripper fingers 18, a control contour 21 is provided at the side. The gripper fingers 18 of each gripper series, as shown in FIG. 4, may be located on a through-going rotary shaft 22 which, as shown in FIG. 2, has a lateral scanning element 23 acting jointly with the control contour 21. To ensure exact adjustability of the opening and closing times of gripper fingers 18, the control contour 21, as indicated by oblong holes 24, may be adjustable. At the start of the engagement stretch, the gripper fingers 18 are controlled by means of curve section indicated at 25. In this condition, the gripper fingers 18 enter the gap produced by the different speed of the track running off roller 1 and the sheet withdrawn by withdrawal device 6, and travel underneath the rear end of the sheet to be lifted, in FIG. 2 sheet 11. The curved section 26 following section 25 of control contour 21 brings about closing of gripper fingers 18 and pressing of the rear end of the grasped sheet against the associated gripper support 19, as shown in FIG. 2 for sheet 12. At the end of the straight gripper track provided by the distance between sprocket wheels 16 and 17 the grasped sheet can be released by controlling the gripper fingers. However, preferably the gripper delay relative to the operating speed of the following withdrawal device 7 achieved either by guide rails or, as here, by merely reducing the speed of the transport chains 15, is chosen so that the rear end of the grasped sheet is just barely withdrawn from the grippers and thus released at the end of the straight gripper track. In this case, control of the gripper fingers is superfluous. Hence the control contour becomes particularly simple. To prevent damage to the rear sheet end when pulling out from the clamping grippers, the holding surfaces of gripper fingers 18 and of the associated gripper support 19 are polished smoothly.

Figure 3:
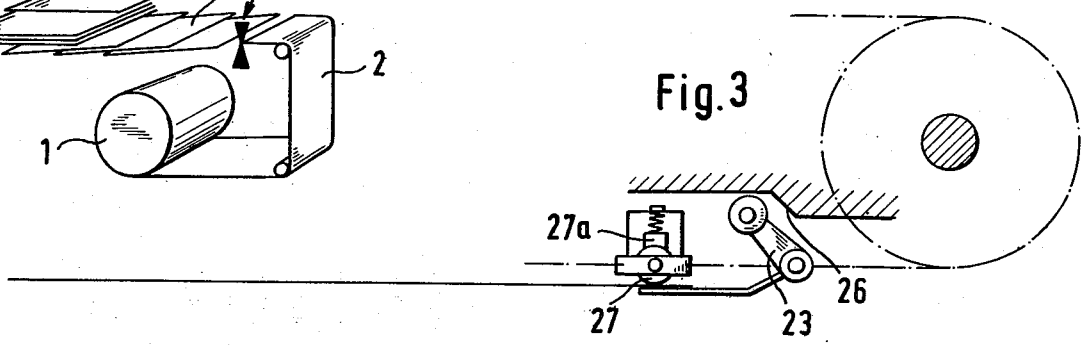
FIG. 3 shows a mechanical gripper arrangement in enlarged form.

As shown in FIG. 3, to form the gripper support, via a spring-supported brake block 27, a sufficiently inert roller 27 may be provided. Also, gripper finger 18 may be provided with an associated counter-roller. This results in particularly careful treatment and hence adequate holding force. With immovably held sheet ends, the relative motion in the gripper area relative to the following withdrawal device 7 caused by the delay in accordance with the invention can be compensated as follows: As shown in FIG. 4, the gripper strips 20 can be spring-connected with the lateral transport chains. For this purpose, there are brackets 28 connected to chains 15; the grippers strips 20 are braced against these brackets by means of springs 29 and suspended movably in the chain direction. Preferably, on the side facing springs 29, a damping device 30 may be provided.

The embodiment described above in various variations and operating with mechanical means, represents an extremely rugged solution which is reliable even under rough operating conditions; it is simple, neat and compact. Another convenient solution of the problem of the invention may be based on the use of blow nozzles. As is well known when a narrow gap is flown through at high speed, a certain vacuum may develop. This phenomenon is used here.

Figure 5:
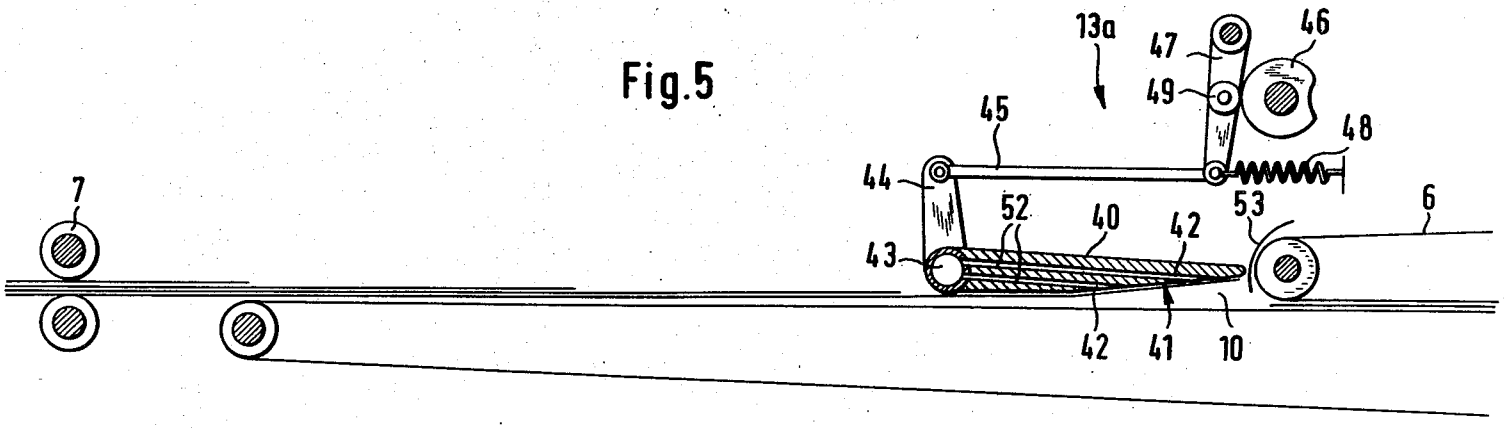
FIG. 5 shows a second embodiment of the device to form a series of underlapping sheets.
Figure 6:
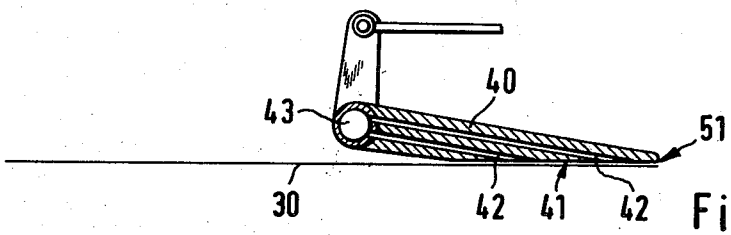
FIG. 6 the blow nozzle arrangement for the sheet feed.

The design, indicated in FIG. 5, of the withdrawal devices which operate at different speeds and which follow the cross-cutter, corresponds to the embodiment described in detail by means of FIG. 2. Hence the same callouts are used for the same parts. The device **13*a*, located between withdrawal devices 6 and 7, to form a series of underlapping sheets has a guide surface 41, which is located above the sheet track and formed here by an oblique face side of a flap 40, for the blast air; this surface is covered with air exit openings forming blow nozzles 42. Flap 40 containing guide surface 41 in the preferred embodiment shown is fastened to a pivoted pipe 43 which is fastened by means of a pivoted lever 44 and a rod 45 to another pivoted lever 47 actuated by a cam disk 46. A spring 48 ensures reliable contact of scanning roller 49 of pivoted lever 47 with the associated cam disk 46. The cam disk 46 is preferably driven from the cross-cutter. Thus the flap 40 comprising guide surface 41 and blow nozzles 42 can be lowered onto the sheet track in the rhythm of the cross-cutter. FIG. 6 shows the flap 40 in the lowered position. The air speed of the air leaving blow nozzles 42 in the gap 51 formed by guide surface 41 and sheet 50 underneath increases in such a way as to produce an underpressure (vacuum) by means of which the rear end of the sheet 50 can be sucked in. When lifting flap 40, the rear end of sheet 50 is also lifted to form a lead-in gap 10 for the sheet next following. The air film formed by the exit air, however, prevents a direct contact between sheet and guide surface. The exit opening of blow nozzles 42** is opposite to the direction of sheet transport. The force exerted on the grasped sheet, opposite to the direction of sheet transport, results in a straightening (stretching) of the entire sheet.

The pipe 43 holding flap 40 may be designed as an air supply pipe which is connected to blow nozzles 42 via lines formed by drill holes 52. In this case, the blow nozzles are simply formed by the exit cross-sections of drill holes 52. The flap 40 may be designed as a part extending throughout the sheet with several adjacent blow nozzles 42. It is also conceivable to provide several adjacent flaps 40. To maintain a clean lead-in gap 10 over a longer time interval, blow nozzles 42 staggered in the sheet transport direction are provided in the area of each flap. To simplify manufacture, the flap 40 may be made of a solid material, a suitable plastic or wood.

In order to protect the assemblies ahead, particularly the withdrawal device 6 and the cross-cutter, from air pressure, suitable screening devices 53 may be provided between flap 40 and withdrawal device 6.

In the above, a preferred embodiment is explained in detail for each of the possibilities, without imposing a restriction. Rather, the expert has a series of possibilities at his disposal to adapt the general idea of the invention to the individual case. For example, in the first case, instead of the mechanical clamping grippers, suction grippers, etc. may be used. In the second case, it might be conceivable to provide a rigid guide surface, say, a suitable guide metal sheet.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A sheet feeding apparatus with a cross-cutter in front; withdrawal devices; means following said cross-cutter for forming a series of underlapping sheets and having lifting and holding elements in a region between two withdrawal devices driven at different feed speeds; said elements lifting the rear end of each sheet to form a lead-in gap for the following sheet; continually driven rotating transport elements; said lifting and holding elements being fastened to said transport elements and being kept on a straight path in the engagement area slightly delayed relative to the following withdrawal device, the effect of said different feed speeds being compensated by a relative movement between said sheets and said holding elements.

2. The sheet feeding apparatus as defined in claim 1, wherein a plurality lift and holding elements are uniformly distributed across the sheet track width, and including a strip fastened to said elements and attached to chains located on a side.

3. The sheet feeding apparatus as defined in claim 2, wherein a plurality of said strips are spaced at the sheet-to-sheet spacing.

4. The sheet feeding apparatus as defined in claim 2, wherein the track of the lift and holding elements descends slightly in the transport direction.

5. The sheet feeding apparatus as defined in claim 3, including lateral chains and lateral guide rails, said strips being connected to said lateral chains and being guided in said lateral guide rails.

6. The sheet feeding apparatus as defined in claim 5, wherein said guide rails are adjustable.

7. The apparatus as defined in claim 1, wherein the speed of said transport elements holding said lift and holding elements is slightly smaller than the operating speed of the following withdrawal device.

8. The apparatus as defined in claim 1, wherein the difference in said speeds is adjusted so that the lift and holding elements disengage from the sheet rear edge precisely at the end of the engagement section.

9. The apparatus as defined in claim 3, wherein said strips are connected elastically to respective ones of said chains.

10. The apparatus as defined in claim 9, including spring means for elastically connecting said strips to said chains; and means for damping said spring means.

11. The apparatus as defined in claim 1, including mechanical grippers with gripper fingers and gripper support contacted by said gripper fingers for forming said holding elements.

12. The apparatus as defined in claim 11, including control contour means located on a side for controlling said gripper fingers.

13. The apparatus as defined in claim 12, wherein said control contour means is adjustable.

14. The apparatus as defined in claim 11, wherein said gripper fingers have a smooth holding surface and said gripper support has a smooth counter surface.

15. The apparatus as defined in claim 14, wherein at least one of said surfaces comprises a roller having substantial inertia.

16. A sheet feeding apparatus with a cross-cutter in front; withdrawal devices; means following said cross-cutter for forming a sequence of underlapping sheets and having lifting and holding elements in a region between two withdrawal devices driven at different feed speeds; said elements lifting the rear end of each sheet to form a lead-in gap for the following sheet; said lifting and holding elements having blow nozzles directed into a gap formed by the sheet to be lifted; a guide surface located above the sheet path; and air shielding means located ahead of the withdrawal device following the cross-cutter.

17. The apparatus as defined in claim 16, wherein said blow nozzles have a blow direction opposite to the direction of movement of said sheets.

18. The apparatus as defined in claim 16, wherein a plurality of adjacent blow nozzles are located across the width of the sheet track and on at least one flap having a guide surface containing blow nozzles.

19. The apparatus as defined in claim 18, including a a cam disk driven from the cross-cutter, said flap being fastened to a pivoted axis actuated by said cam disk.

20. The apparatus as defined in claim 19, wherein said axis holding said flap comprises an air supply pipe connected to said blow nozzles through drill holes in said flap.

* * * * *